United States Patent [19]
Przybylinski
[11] 4,317,532
[45] Mar. 2, 1982

[54] PNEUMATIC DISCHARGE ARRANGEMENT

[75] Inventor: Phillip Przybylinski, Shererville, Ind.
[73] Assignee: Pullman Incorporated, Chicago, Ill.

[21] Appl. No.: 88,877
[22] Filed: Oct. 29, 1979
[51] Int. Cl.[3] ..... B65D 28/72; B65D 90/58
[52] U.S. Cl. ..... 222/505; 222/557; 222/559; 222/560; 406/130
[58] Field of Search ..... 222/505, 559, 561, 556, 222/557, 560, 544; 406/128, 130, 131

[56] References Cited

U.S. PATENT DOCUMENTS 1,982,773 12/1934 Walborn ..... 222/505 X
3,637,262 1/1972 Adler ..... 406/128
3,693,839 9/1972 Shaver et al. ..... 406/128
3,700,143 10/1972 Shaver et al. ..... 222/561 X
3,724,909 4/1973 Adler ..... 406/128 X
4,200,208 4/1980 Hassenauer ..... 222/505

*Primary Examiner*—Robert J. Spar
*Assistant Examiner*—Frederick R. Handren
*Attorney, Agent, or Firm*—Paul A. Kerstein

[57] ABSTRACT

A pneumatic discharge arrangement for railway hopper cars includes a housing secured to a discharge end of a hopper including a chamber having an elongated opening. The opening is regulated by a sliding pivoting valve disposed beneath the opening within a trough that is adapted to be connected to a pneumatic conveyer. Movement of the sliding pivoting valve is accomplished by an operating mechanism from either side of the railway car.

17 Claims, 7 Drawing Figures

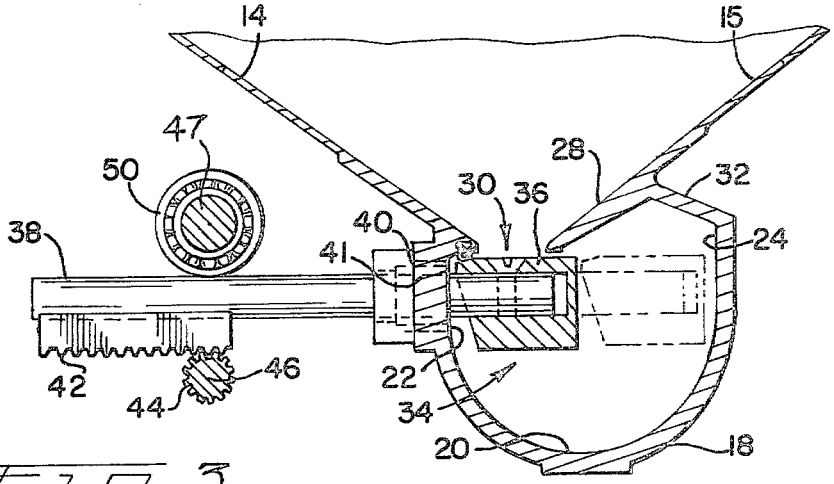
FIG. 3
FIG. 4
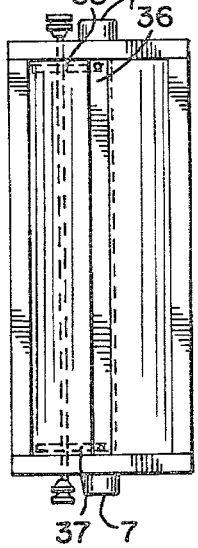
FIG. 5
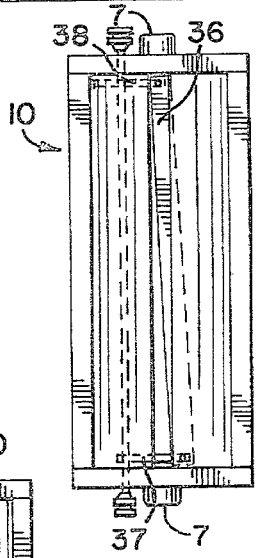
FIG. 6
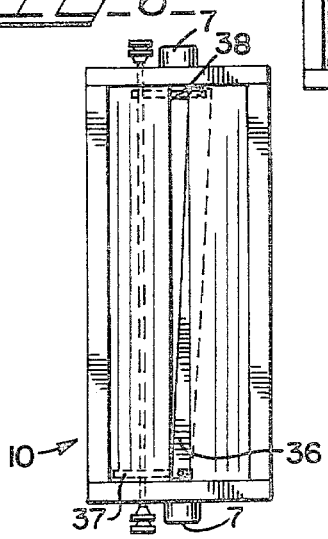
FIG. 7
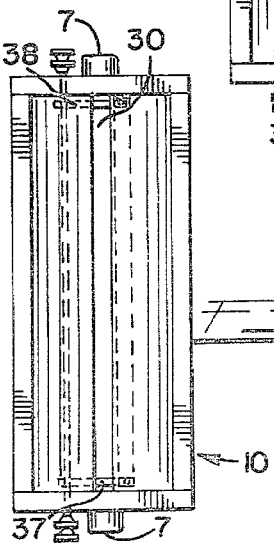

PNEUMATIC DISCHARGE ARRANGEMENT

BACKGROUND OF THE INVENTION

1. Field of the Invention

The present invention relates to pneumatic discharge arrangements located at the lower ends of discharge hoppers and particularly to the type of hopper which is carried on a railway hopper car.

2. Description of the Prior Art

The Prior Art includes U.S. Pat. Nos. 3,637,262; 3,693,839; 3,700,143; 3,724,909, which refer to the art of pneumatic discharge arrangements.

U.S. Pat. No. 3,637,262 discloses a pneumatic discharge arrangement wherein a valve element 46 can be moved free and clear of sloping walls and the valve member 30. U.S. Pat. No. 3,693,839 also teaches a pneumatic discharge arrangement with the addition of aeration pads and a plenum chamber.

U.S. Pat. No. 3,700,143 shows a pneumatic discharge arrangement including a tunnel provided therein facilitating cleaning of the valve. Also, U.S. Pat. No. 3,724,909 is listed to show a trough beneath a discharge opening that is in the shape of a U-shaped conduit accessible at either end.

SUMMARY OF THE INVENTION

The prime object of this invention is to provide an improved pneumatic discharge arrangement for hoppers which may be carried on railway hopper cars. The arrangement calls for fewer parts, is less costly and provides for a more durable and reliable valve.

Pneumatic discharging is particularly useful for materials that are granular, particulate comminuted, or pelletized such as plastic pellets and the like. The pneumatic discharge arrangement comprises a boxlike structure with walls sloping downwardly to a discharge opening. A tube extends transversely beneath the opening and is adapted to be connected to a pneumatic conveyer at either end. The structure includes a valve arrangement which traverses the entire length of the discharge opening and is operable from either side thereof.

When employing pneumatics for discharging, care must be exhibited in regulating the flow of material into the tube for discharge. Too much material and the pneumatic conveyor will not function, the material being unable to flow; too little material and efficiency is reduced. To accomplish efficient metering of material the present invention calls for a valve that is slidable and pivotally connected at its ends to transverse control rods. The rods actuate movement of the valve far and near by a gear engagement with shafts longitudinally spaced.

The valve arrangement is more efficient and provides cost savings by requiring less structure and less moving parts. Also, synchronization of engaging gears is a problem, of the prior art, produced by downward forces of material on the valve creating bending or moment forces in the control rods causing gear slippage and separation forces inherent in the meshing of gears with the standard tooth profile. As the operation of the valve gets harder due to material thereon, higher gear forces are applied creating higher separation forces. These separation forces deflect the shafts which the gears are mounted on thereby causing "skip" and eventual disengagement of the gears. Overcoming this, the present invention provides the control rod to be pinned between a bearing and gears allowing for smooth operation while resisting separation and moment forces. Further, this arrangement allows for a shorter control rod, and the need for the control rod only being placed through one wall of the trough, facilitating fabrication. Thus, it also eliminates extra bearing support assemblies associated therewith.

BRIEF DESCRIPTION OF THE DRAWINGS

FIG. 3 is a cross-section taken along line 3—3 of FIG. 1.

FIGS. 4 through 7 are top views showing the improved hopper discharge structure in its various positions of operations.

DESCRIPTION OF THE PREFERRED EMBODIMENT

Figure 1:
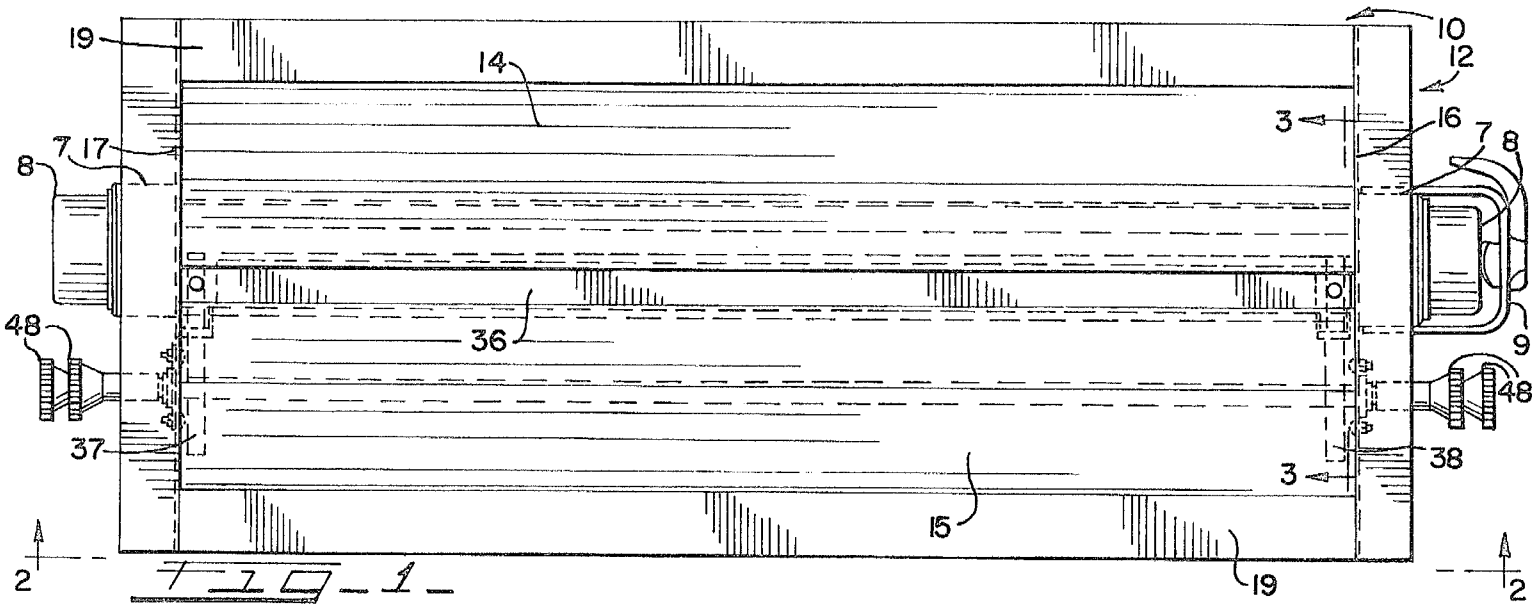
FIG. 1 is a top plan view of the improved hopper discharge structure.
Figure 2:
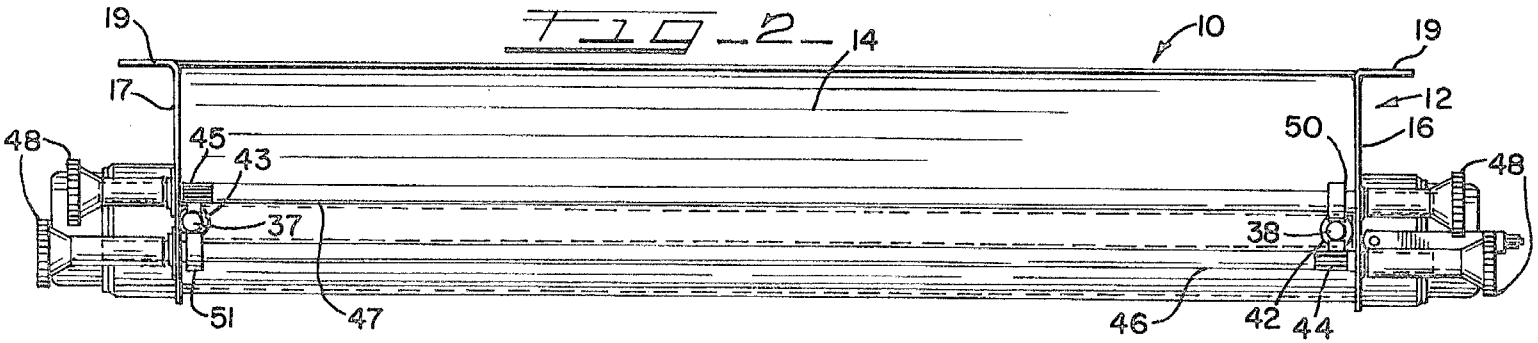
FIG. 2 is a front view taken substantially along line 2—2 of FIG. 1.

Referring to FIGS. 1 and 2, a hopper discharge structure is generally designated by reference numeral 10. The discharge structure 10 includes a discharge housing 12 having transversely spaced downwardly sloping walls 14 and 15 connected at their opposite ends to vertical end walls 16 and 17. The housing 12 is adapted to be suitably secured to the discharge end of a hopper structure which may be supported on a railway hopper car. Facilitating the connection to a hopper structure, attaching flanges 19 are connected to the upper ends of sloping walls 14 and 15 and end walls 16 and 17. The flanges 19 extend outwardly and horizontally therefrom and may be made to be mechanically or otherwise fastened to a hopper structure.

As generally shown in FIG. 1, opposite ends of trough 18 are provided with outlet tubes 7 extending outwardly from opposite sides of the end walls 16 and 17. Each outlet tube is adapted to be engaged by a closure member 8. Further a bail shaped locking mechanism 9 (only shown on the right hand side) is fitted to releasably secure closure member 8 over outlet tube 7.

The tubular trough 18 is disposed below the sloping walls 14 and 15 and runs the entire length of the housing 12. The trough 18 includes a lower arcuate wall portion 20 connected to vertical walls 22 and 24. As best seen in FIG. 3, sloping wall 14 is connected at its lower end to vertical wall 22. Sloping wall 15 includes an extension 28 which protrudes transversely across the trough 18 and along with vertical wall 22 forms an elongated opening 30. The extension 28 is connected to vertical wall 24 by connection wall 32 which runs diagonally therebetween.

In FIG. 3 the valve assembly for regulating the meter discharge of material through opening 30 is generally designated by reference number 34. The valve assembly includes a valve member 36 which in its closed position spans the elongated opening 30 preventing material from being discharged. The valve member 36 is supported on and pivotally connected at its end to operating rods 37 and 38. The rods 37 and 38 extend transversely through wall 22 of trough 18. The wall 22 is fitted with bearings 40 and suitable slide bores 41 to slidably support rods 37 and 38.

The rods 37 and 38 have rack teeth 42 disposed at its opposite end from its pivotal connection with the valve member 36. The rack teeth 42 on rod 38 are disposed on its underside while the rack teeth 42 of rod 37 are located on its top side. The rods 38 and 37 are disposed between operating shafts 46 and 47 which are parallelly spaced in a vertical plane and run laterally between end walls 16 and 17. The shafts 46 and 47 have operating heads 48 disposed at their ends to be engaged with a suitable tool for rotating the shafts.

As best seen in FIG. 2 operating shaft 46 is disposed beneath shaft 47 and includes pinion teeth 44 at its right end portion engaging rack teeth 42 of rod 38. The rod 38 is in contact with roller bearing 50 mounted on shaft 47. This arrangement allows for the transverse sliding movement of rod 38. To allow for rod 37 movement, pinion teeth 45 are located at the left end portion of shaft 47 and engage rack teeth 43 of rod 37. Further, rod 37 contacts roller bearing 51 mounted on shaft 46. This placement of the bearings 50 and 51 on shafts 46 and 47, respectively, allows for smooth lateral movement of the rods 37 and 38, while providing for increased support for the valve member 36. It also maintains the rack teeth 42 and pinion teeth 44 to be in constant contact resisting moment and separation forces caused by lading pressing on the valve member 36. This arrangement facilitates use of a shorter operating rod while keeping the gear teeth from slipping out of synchronization.

The Operation

In FIG. 4 the valve member 36 is in the closed position preventing material from entering trough 18 through opening 30. However FIGS. 5, 6 and 7 show the valve member in its various positions of operation.

When it is desired to discharge materials from the hopper discharge structure 10 the closure member 8 is removed from either end and a pneumatic conveying system is connected to one of the outlet tubes 7. The flow of material through opening 30 must be regulated, for the entry of too large a quantity of material in the trough 18 will prevent the conveying of material out the tube 7. Also, if the total elongated opening 30 is exposed in the initial discharge of material the pneumatic conveyer will only pull material closest to it and then will only pull air and not material. Therefore, each end of the opening 30 may be exposed individually. Initially the left end of the opening 30 will be exposed as in FIG. 5. To accomplish this, operating shaft 46 is rotated by turning its operating head 48. This movement causes the pinion teeth 44 to engage the rack teeth 42 of rod 38 moving it transversely toward vertical wall 24. The valve member 36 pivotally connected at its left end portion to rod 38 pivots and slides towards wall 24 exposing left portion of opening 30.

Now to empty the pellets in the right portion of the hopper discharge structure 10 the left portion of the opening must be closed. This is accomplished by the reverse of the procedure described above. If this is not done when the right portion is exposed the pneumatic conveyer would draw air only from the left portion of the car and no material from the right portion. When the left portion of opening 30 is closed the right portion of opening 30 is exposed by rotating operating shaft 47. By this rotation the pinion teeth 45 of shaft 47 engage rack teeth 43 of rod 37 moving it transversely toward wall 24 pivotally sliding valve member 36 connected to it. This exposes the right portion of opening 30 as shown in FIG. 6.

Once discharge is complete a cleanout operation can be effectuated by the operation of shaft 46 as hereinabove described to expose the left portion of the opening 30. This mode as seen in FIG. 7 now exposes the total elongated opening 30 for easy access.

I claim:

1. A pneumatic hopper discharge structure comprising, a discharge housing including a pair of generally vertical end walls connected at their ends to a pair of transversely spaced walls sloping downwardly to form an opening, a trough including a pair of transversely spaced generally vertical walls interconnected at their lower portions by a bottom wall, said trough communicating with said opening, said trough having conduit means at its ends suitably adapted for connection to pneumatic conveying means, a valve member traversing said opening and being slidable and pivotally connected at its opposite ends to valve actuating means for selectively pivoting the opposite ends of said valve member in a generally horizontal plane, said valve actuating means comprising a pair of generally parallel rod members located in a generally horizontal plane beneath said opening, said rod members being mounted for transverse sliding movement and pivotally connected to the opposite ends of the valve member and means for independently driving said rod members.

2. A pneumatic hopper discharge structure in accordance with claim 1, said rod members having first gear elements disposed at one end portion thereof.

3. A pneumatic hopper discharge structure in accordance with claim 2, said means for independently driving said rod members comprising a pair of shaft elements generally parallelly spaced in a generally vertical plane and disposed laterally between said end walls, and said shaft elements including first bearing devices and second gear elements.

4. A pneumatic hopper discharge structure in accordance with claim 3, said rod members being disposed between said pair of shaft elements and engaging said first bearing devices of said shaft elements, and said first gear elements of said rod members engaging said second gear elements of said shaft elements.

5. A pneumatic hopper discharge structure in accordance with claim 4, said rod members being movably disposed between said pair of shaft elements for effecting movement of either end of said valve member and transversely extending through one of said vertical walls including second bearing devices and being movably supported by said second bearing devices.

6. A pneumatic hopper discharge structure in accordance with claim 5, said shaft elements including operating means at its end portions suitably adapted to rotate said shaft elements from either end and thereby translate said rotation in linear motion of the rod members by the first and second gear elements.

7. An improved valve arrangement for use in pneumatic hopper discharging structures having an opening, and a trough communicating with said opening, comprising a valve member disposed for movement in a generally horizontal plane below said opening within said trough, and being coextensive with said opening, means for supporting said valve member including generally parallel rod members located in a generally horizontal plane beneath said opening, said rod members being mounted for transverse sliding movement and pivotally connected to opposite ends of the valve member and means for independently driving said rod members to effect independent, generally horizontal, movement of the opposite ends of the valve member.

8. The improved valve arrangement in accordance with claim 7, said trough including a pair of generally vertical walls connected at their lower portions by a bottom wall, one of said generally vertical walls including second bearing devices, and said rod members extending generally horizontally from said connection with said valve member through one of said vertical walls and being slidably supported therein by said second bearing devices.

9. The improved valve arrangement in accordance with claim 8, said means for independently driving said rod members including a pair of parallel spaced shaft elements disposed in a generally vertical plane between said end walls, said rod members including first gear elements at its opposite end portion from its connection with said valve member, and said rod members also being transversely disposed between said shaft elements.

10. An improved valve arrangement in accordance with claim 9, said shaft elements including second gear elements disposed at one end and said first bearing devices disposed at the other end.

11. An improved valve arrangement in accordance with claim 9, said rod members being engaged by said first bearing devices of said shaft elements and said first gear elements of said rod members being engaged by said second gear elements of said shaft elements.

12. An improved valve arrangement in accordance with claim 9, said shaft elements being suitably adapted to be rotated, and said rotation being translated to linear motion of said rod members by said first and second gear elements thereby slidably and pivotally moving said valve member from beneath said opening.

13. A pneumatic hopper discharge structure comprising, a discharge housing including a pair of generally vertical end walls connected at their ends to a pair of transversely spaced walls sloping downwardly to form an opening, a trough including a pair of transversely spaced generally vertical walls interconnected at their lower portions by a bottom wall, said trough communicating with said opening, said trough having conduit means at its ends suitably adapted for connection to pneumatic conveying means, a valve member transversing said opening and being slidable and pivotally connected at its ends to valve actuating means for selectively pivoting opposite ends of said valve member in a generally horizontal plane, said valve actuating means comprising a pair of rod members generally parallelly spaced in a generally horizontal plane disposed beneath said opening, said rod members being mounted for transverse sliding movement and pivotally connected with said valve member at is opposite ends, means for independently driving said rod members, said rod members having first gear elements disposed at one end portion, said means for independently driving said rod members comprising a pair of shaft elements generally parallelly spaced in a generally vertical plane and disposed laterally between said end walls, said shaft elements including first bearing devices and second gear elements, said rod members being disposed between said pair of shaft elements and engaging said first bearing devices of said shaft elements, and, said first gear elements of said rod members engaging said second gear elements of said other shaft element.

14. A pneumatic hopper discharge structure in accordance with claim 13, said rod members being movably disposed between said pair of shaft elements for movement of either end of said valve member and transversely extending through one of said vertical walls of said trough and being movably supported by second bearing devices therein.

15. A pneumatic hopper discharge structure in accordance with claim 14, said shaft elements including operating means at its end portions suitably adapted to rotate said shaft elements from either end and thereby translate said rotation into linear motion of the rod members by the first and second gear elements.

16. An improved valve arrangement for use in pneumatic hopper discharging structures having an opening, and a trough communicating with said opening, comprising a valve member disposed below said opening within said trough, and being coextensive with said opening and means supporting said valve member for slidable movement in a generally horizontal plane, said means including horizontally spaced rod members, said valve member being pivotally connected to, and supported at its end portions, by said rod members said trough including a pair of generally vertical walls connected at their lower portions by a bottom wall, one of said generally verticle walls including second devices, said rod members extending generally horizontally from said connection with said valve member through one of said vertical wall and being slidably supported therein by said second bearing devices, means for independently driving said rod members including a pair of parallelly spaced shaft elements disposed in a generally vertical plane disposed between said end walls, said rod members including first gear elements at its opposite end portion from its connection with said valve member, said rod members also being transversely disposed between said shaft elements, each said shaft element including a second gear element disposed at one end and a said first bearing device disposed at its other end, said rod members being engaged by said first bearing devices of said shaft elements and said first gear elements of said rod members being engaged by said second gear elements of said shaft elements.

17. An improved valve arrangement in accordance with claim 16, said shaft elements being suitably adapted to be rotated, and said rotation being translated to linear motion of said rod members by said first gear means thereby slidably and pivotally moving said valve member from beneath said opening.

* * * * *